US006981558B2

(12) United States Patent
Riedl

(10) Patent No.: US 6,981,558 B2
(45) Date of Patent: Jan. 3, 2006

(54) CONTROLLER FOR AN UNBALANCED MASS ADJUSTING UNIT OF A SOIL COMPACTING DEVICE

(75) Inventor: Franz Riedl, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/473,475

(22) PCT Filed: Apr. 17, 2002

(86) PCT No.: PCT/EP02/04260

§ 371 (c)(1),
(2), (4) Date: Sep. 26, 2003

(87) PCT Pub. No.: WO02/087789

PCT Pub. Date: Nov. 7, 2002

(65) Prior Publication Data

US 2004/0101367 A1 May 27, 2004

(30) Foreign Application Priority Data

May 2, 2001 (DE) ..... 101 21 383

(51) Int. Cl.
*E02D 7/18* (2006.01)

(52) U.S. Cl. ..... 173/49; 173/206

(58) Field of Classification Search ..... 173/49, 173/24, 90, 96, 100, 206, 207, 135; 404/133.05, 404/117

See application file for complete search history.

(56) References Cited

U.S. PATENT DOCUMENTS

| | | | | | |
|---|---|---|---|---|---|
| 3,004,389 | A | * | 10/1961 | Muller | 30/369 |
| 3,708,978 | A | * | 1/1973 | Reiff et al. | 60/443 |
| 4,040,255 | A | * | 8/1977 | Hara | 60/445 |
| 4,650,008 | A | * | 3/1987 | Simson | 173/91 |
| 4,771,645 | A | * | 9/1988 | Persson | 74/61 |
| 4,913,457 | A | * | 4/1990 | Hafner et al. | 280/5.514 |
| 5,253,542 | A | * | 10/1993 | Houze | 74/61 |
| 5,410,879 | A | * | 5/1995 | Houze | 60/469 |
| 5,618,133 | A | * | 4/1997 | Mitsui et al. | 404/117 |
| 6,227,760 | B1 | * | 5/2001 | Togami et al. | 404/84.1 |

FOREIGN PATENT DOCUMENTS

| | | |
|---|---|---|
| EP | 0 655 532 A1 | 11/1994 |
| EP | 0 960 659 A1 | 12/1999 |
| WO | WO/9603224 A1 | 2/1996 |

* cited by examiner

*Primary Examiner*—Stephen F. Gerrity
*Assistant Examiner*—Paul Durand
(74) *Attorney, Agent, or Firm*—Boyle Fredrickson Newholm Stein & Gratz S.C.

(57) ABSTRACT

The invention relates to a controller for an unbalanced mass adjusting unit in a vibration exciter. Said controller comprises an adjusting piston for changing the relative position of unbalanced masses in the vibration exciter that is coupled to a reference piston. The position of a piston rod of the reference piston is detected by a pressure sensor and is furnished to a controller in the form of a position signal. The controller compares the position signal with an operating signal given by an operator and generates a control signal with which the position of a selector valve that controls the oil supply to or the oil discharge from the reference piston can be changed.

23 Claims, 1 Drawing Sheet

CONTROLLER FOR AN UNBALANCED MASS ADJUSTING UNIT OF A SOIL COMPACTING DEVICE

BACKGROUND OF THE INVENTION

1. Field of the Invention

The invention relates to a controller for an unbalanced mass-adjusting unit in a vibration exciter.

2. Description of the Related Art

Vibration exciters of this type are known in particular for use in ground-compaction machines, such as vibration plates or rollers. Conventionally, two—but also several—unbalanced shafts are driven in a positive manner rotating in opposite directions, wherein the superposition of the centrifugal forces of each individual unbalanced shaft serves to produce a resulting force which depending upon the design of the vibration exciter can be adjusted with respect to its value and/or direction. Vibration exciters of this type have been known for a long time particularly in the case of vibration plates, so that a further description thereof would be superfluous.

In order to adjust the desired value or the direction of the resulting force vector, it is necessary to be able to change the relative positions of the unbalanced shafts with respect to each other or of the unbalanced masses in relation to the shafts which support them. To this end, either the counter-rotating unbalanced shafts can be adjusted with regard to their mutual phase position or the position of the unbalanced mass on the shaft supporting it can be changed. For this purpose, unbalanced mass-adjusting units are known, wherein a transverse spigot which can be adjusted in an axial manner by an adjusting piston in an unbalanced shaft which is formed as a hollow shaft passes through a longitudinal slit in the wall of the hollow shaft and engages into a spiral groove on the inner side of a hub which supports an unbalanced mass. In the event that the transverse spigot is displaced axially, the transverse spigot is guided in the longitudinal slit, whereby the effect of the spiral groove causes the hub to change its relative position on the shaft which supports it. Therefore, it is possible to achieve the desired, above-described adjustment of the phase position. This structure has also been known for a long period of time and is illustrated e.g. in EP-A-0 960 659.

In the case of vibration exciters, the adjusting units thus serve to adjust the phase positions of unbalanced masses with respect to each other in order to reverse the direction of travel or in order to change the so-called "m·r-value". They are based upon an hydraulic adjustment by means of a piston which is influenced on one side and which in the event of falling oil pressure is reset either by way of a spring device or by way of the restoration moment exerted by means of the unbalanced masses.

EP-A-0 960 659 also describes a controller for an unbalanced mass-adjusting unit, wherein the adjusting piston is hydraulically coupled to a reference piston. The position of the reference piston is controlled by way of a pilot valve. In turn, the position of the pilot valve is governed by forces which act upon the valve body from two sides, namely on one side by means of a force which can be predetermined by the operator and can be introduced by way of a spring into the valve body, and on the other side by means of a force which is exerted on to the valve body by means of the reference piston by way of a spring. The known controller is difficult to adjust and does not render it possible to perform different control algorithms. In order to carry out an adjustment or effect a change in the adjustment, it is necessary on each occasion to change the characteristic curves of the sets of springs which influence the valve body, which constitutes either substantial structural or substantial assembly outlay.

In the case of more complex vibration exciters, in which in addition to adjusting the phase position it is also possible to adjust the mr-value and thus under certain circumstances several unbalanced mass-adjusting units are provided, it is necessary to obtain a reliable signal relating to the respective position of the adjusting piston and therefore of the unbalanced masses in the exciter which are adjusted by said adjusting piston.

OBJECTS AND SUMMARY OF THE INVENTION

It is the object of the invention to provide a controller for an unbalanced mass-adjusting unit in a vibration exciter, wherein it is possible to detect in a precise manner the position of the adjusting piston and to perform a convenient and reliable actuation in the event of changes in the position of the adjusting piston. Furthermore, it should be possible to detect the respective position of the adjusting piston and thus of the unbalanced masses or unbalanced shafts which are actuated by said adjusting piston. The object is achieved in accordance with the invention by means of a controller as claimed in claim 1. Advantageous further developments of the invention are evident in the dependent claims.

In the case of the controller in accordance with the invention, the position of the reference piston which is hydraulically coupled to the adjusting piston is detected by a signal-generating device and is relayed in the form of a position signal. The reference piston can be provided with a piston rod, whose position corresponds to the position of the reference piston and thus renders it possible to draw precise conclusions with respect to the position of the adjusting piston and thus the unbalanced masses or unbalanced shafts which are influenced by the adjusting piston.

The position signal is transmitted to the control device which can be e.g. an electronic regulating device and which is also influenced by means of an operating signal provided by an operator. The control device compares the position signal, which corresponds to an actual value of the position of the unbalanced masses in the vibration exciter, to the operating signal which in this respect can be regarded as a desired value. The operating signal can be information which is specified by the operator relating to the direction of travel but also the vibration intensity which is to be generated by the vibration exciter.

The control device then generates a control signal which is used for the purpose of actuating a pilot valve, in order to control the supply of oil to and the discharge of oil from the second side of the reference piston. It is thus possible by way of the control device to change the position of the reference piston and consequently also to change the position of the adjusting piston.

By reason of the presence of the position signal and thus the reliable information relating to the position of the unbalanced masses in the vibration exciter, it is possible with the aid of the control device to perform any control algorithms. If the control device is an electronic controller, then for this purpose it is only necessary to perform changes to the electronically stored program.

In the case of a particularly advantageous embodiment of the invention, the adjusting piston is disposed on the vibration exciter, whereas the reference piston is disposed in a region which in terms of vibration is uncoupled from the vibration exciter. This embodiment can be accomplished in a particularly advantageous manner in the case of a ground-compaction device, e.g. a vibration plate which is defined in claim 12 and comprises an upper mass, which comprises a drive, and a lower mass which supports the vibration exciter and is coupled to the upper mass by way of a spring device, wherein the adjusting piston of the controller is disposed on the lower mass and the reference piston is disposed on the upper mass. Since, for the purpose of detecting the position of the reference piston or its piston rod, it is necessary to provide vibration-sensitive components, e.g. proximity sensors, pressure sensors or optical sensors, it is particularly advantageous if the reference piston is disposed on the upper mass, which vibrates to a lesser extent, of the ground-compaction device and not in the proximity of the vibration exciter. This brings about lower stress-loading of the sensitive components and a resulting greater degree of reliability and accuracy in the measurements.

BRIEF DESCRIPTION OF THE DRAWINGS

These and further advantages and features of the invention will be explained in detail hereinunder by means of an example with reference to the single FIGURE, in which.

DETAILED DESCRIPTION OF THE PREFERRED EMBODIMENT

Figure 1:
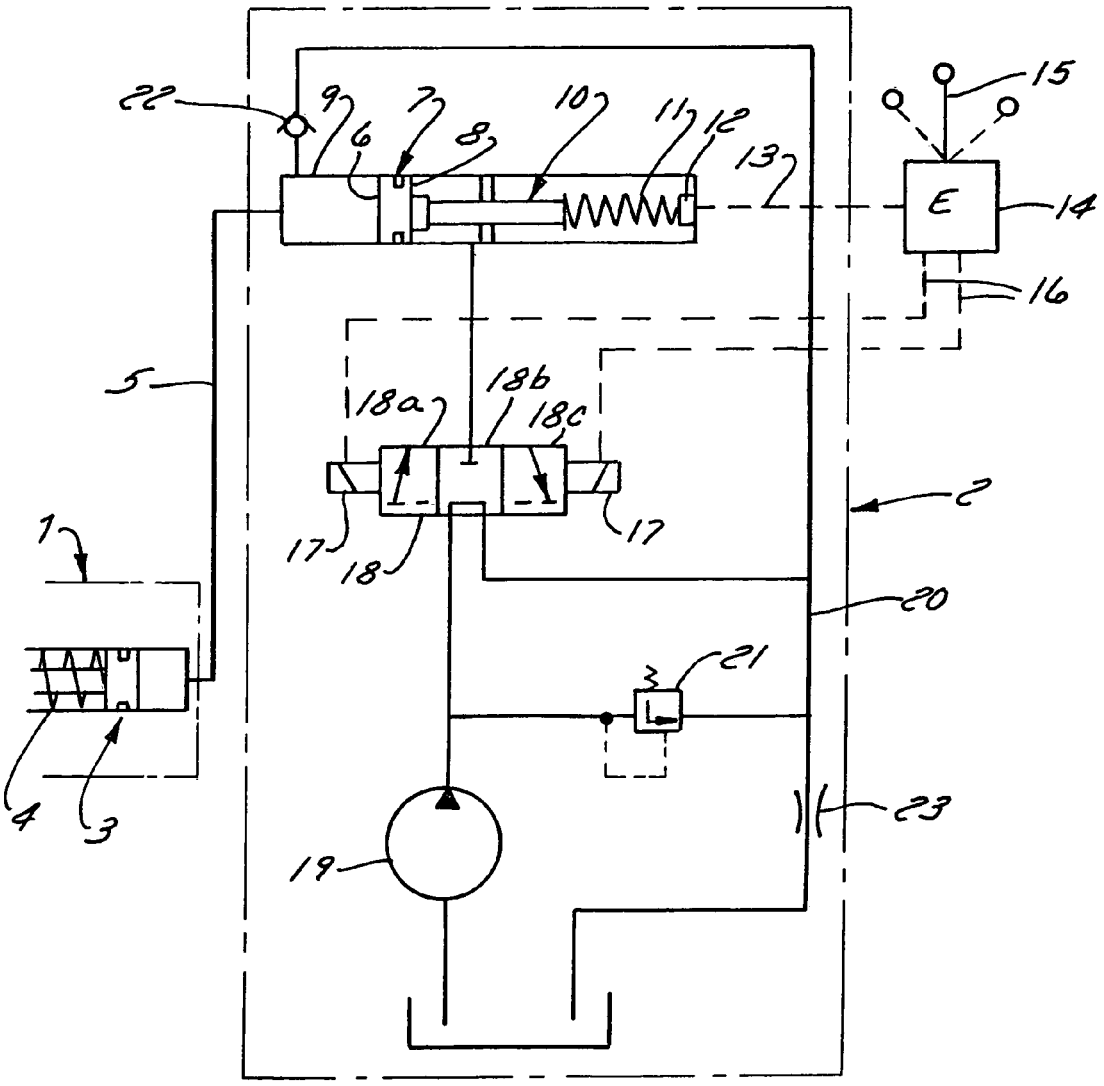
FIG. 1 shows a block diagram of a controller in accordance with the invention.

FIG. 1 illustrates a section of a ground-compaction device, e.g. a vibration plate, in which the controller in accordance with the invention is used.

A vibration exciter 1 which is known per se and is described above is disposed on a lower mass of the ground-compaction device. A ground contact plate, not illustrated, for the purpose of compacting the ground is also provided on the lower mass.

Located above the lower mass—separated in a known manner by a spring-damper system, not illustrated,—is an upper mass 2 which comprises inter alia the drive. Disposed directly on the vibration exciter 1 is an adjusting piston 3, of which one side is influenced by means of a spring 4. Its other side is connected by way of an hydraulic line 5 to a first side 6 of a reference piston 7 which is disposed on the upper mass 2. Disposed on a second side 8 of the reference piston 7, which is axially movable in a cylinder 9, is a piston rod 10 which is supported by way of a spring 11 against a pressure sensor 12. The pressure sensor 12 which serves as a signal-generating device detects the pressure exerted by the spring 11 and thus by the reference piston 7 and converts this pressure into a position signal 13 which indicates the position of the piston rod 10. The position signal 13 is transmitted to a control device 14. The control device 14 also obtains an operating signal 15 which is generated from operating procedures performed by the operator, e.g. an actuation of a lever or push-buttons or even by remote-control.

The position signal 13 can also be output via an optical or acoustic display, in order to provide the operator with information relating to the behaviour of the ground-compaction device.

In dependence upon the position signal 13 and upon the operating signal 15 which reflects the wish of the operator, the control device 14 which is configured as an electronic regulating device determines which measures are required, in order to satisfy the operator's wish. Accordingly, it generates a control signal 16 which is transmitted to magnet coils 17 of a pilot valve 18. The pilot valve 18 illustrated in FIG. 1 and comprising the magnet coils 17 is provided for illustrative purposes only. Of course, the control signal 16 can be transmitted various ways to a valve and its position can be changed.

The pilot valve 18 is a 3 port, 3 position directional control valve which can be switched between three positions 18*a*, 18*b* and 18*c*. It serves to control an oil supply from an oil pump 19, which is used as a pressure oil source, to the second side 8 of the reference piston 7, or it serves to control a discharge of oil from the second side 8 to an oil return line 20.

FIG. 1 illustrates the pilot valve 18 in the position 18*b*, in which a supply of oil to and a discharge of oil from the second side 8 of the reference piston 7 is interrupted. The position 18*a* enables the supply of oil, whereas the position 18*c* enables the discharge of oil into the return line 20.

Furthermore, a safety valve 21 is provided between the pressure-side of the oil pump 19 and the oil return line 20.

The first side 6 of the reference piston 7 is likewise connected to the oil return line 20 by way of a non-return valve 22, wherein the non-return valve 22 is installed in such a manner that it prevents the flow of oil back from the first side 6 of the reference piston 7 to the oil return line 20.

Finally, the oil return 20 is provided with a restrictor 23.

The presence of oil in the hydraulic line 5 ensures that in terms of their movements the adjusting piston 3 and the reference piston 7 are coupled in a precise manner. Any change to the adjusting piston 3 also effects a change to the reference piston 7, which change is detected via the piston rod 10 and the pressure sensor 12 and is transmitted to the controller 14.

Then, in dependence upon the operator's wish and the operating signal 15 resulting therefrom, the controller 14 introduces suitable measures by actuating the pilot valve 18. For example, a supply of oil to the second side of the reference piston 7 is switched via the pilot valve to position 18*a* which serves to displace the reference piston 7 to the left, as shown in FIG. 1. As a consequence, the adjusting piston 3 is also displaced to the left.

If, conversely, the extreme right-hand position of the pistons is to be achieved, the pilot valve 18 is switched to position 18*c*, so that the oil is able to flow from the second side 8 of the reference piston 7 into the oil return line 20. As a consequence, the pressure of the oil in the hydraulic line 5 and on the first side 6 of the reference piston 7 becomes zero, so that by virtue of the effect of the spring 4 or by the inertia effect of the unbalanced masses supported by the adjusting piston 3, the said adjusting piston is likewise displaced to the right until it comes to rest against the mechanical stop of the cylinder which accommodates it.

The reference piston 7 follows this movement for as long as until the adjusting piston comes to this standstill. If the quantity of oil in the hydraulic line 5 and on the first side 6 is too small, e.g. by reason of leakage losses, the reference piston 7 is not able to achieve its extreme right-hand position. However, by reason of the restrictor 23 which forms a flow-obstacle, the oil in the oil return line 20 is at a certain residual pressure which is sufficient to open the non-return valve 22. It is necessary to take into consideration that there is practically no more oil pressure in the hydraulic line 5 and on the first side 6. It is thus possible by way of the non-return valve 22 for oil to flow subsequently to the first side 6 of the reference piston 7 and for any leakage losses to be compensated for. The leakage losses are compensated for by means of the different pressurisation surfaces on the first side 6 and the second side 8 of the reference piston 7 until the reference piston achieves its extreme right-hand position.

What is claimed is:

1. A controller for an unbalanced mass-adjusting unit in a vibration exciter, comprising:

an adjusting piston which can be actuated hydraulically for the purpose of changing the relative position of unbalanced masses in the vibration exciter;

a reference piston whose first side is hydraulically coupled to one side of the adjusting piston;

a signal-generating device for the purpose of generating an electrical position signal in dependence upon a position of the reference piston;

a control device which can be influenced by the electrical position signal and by an operating signal which is provided by an operator, wherein the control device generates a control signal in dependence upon the electrical position signal and the operating signal; and a pilot valve which is coupled to the reference piston for the purpose of controlling a supply of oil from a pressure oil source or controlling a discharge of oil to an oil return line on a second side of the reference piston, wherein the position of the pilot valve can be changed in dependence upon the control signal of the control device.

2. A controller as claimed in claim 1, wherein the position of the adjusting piston can only be changed by changing the position of the reference piston.

3. A controller as claimed in claim 1, wherein the hydraulic volume between the adjusting piston and the reference piston is substantially constant.

4. A controller as claimed in claim 1, wherein the adjusting piston is disposed on the vibration exciter and the reference piston is disposed in a region which in terms of vibration is uncoupled from the vibration exciter.

5. A controller as claimed in claim 1, wherein the signal-generating device comprises a proximity sensor, an induction coil, a pressure sensor or an optical sensor.

6. A controller as claimed in claim 1, wherein the electrical position signal can be output by the signal-generating device via an optical or acoustic display.

7. A controller as claimed in claim 1, wherein the electrical position signal indicates an actual position of the unbalanced masses and the operating signal-indicates a desired position of the unbalanced masses, and wherein a regulating device is provided in the control device and generates the control signal in dependence upon the actual value and upon the desired value.

8. A controller as claimed in claim 1, wherein the first side of the reference piston is connected by way of a non-return valve to the oil return line, wherein the non-return valve is disposed in such a manner that it prevents a discharge of oil from the first side of the reference piston to the oil return line.

9. A controller as claimed in claim 1, wherein a flow-obstacle or a restrictor is disposed in the oil return line.

10. A controller as claimed in claim 1, wherein the reference piston is provided with a piston rod and the signal-generating device is formed for the purpose of generating the electrical position signal in dependence upon a position of the piston rod.

11. A controller as claimed in claim 10, wherein the piston rod is disposed on the second side of the reference piston.

12. A ground-compaction device, comprising:

an upper mass which comprises a drive;

a lower mass which comprises a vibration exciter driven by the drive and which is coupled to the upper mass by way of a spring device; and further comprising a controller as claimed in claim 1 for the purpose of controlling the vibration exciter;

wherein the adjusting piston of the controller is disposed on the lower mass and the reference piston is disposed on the upper mass.

13. A ground-compaction device, comprising:

an upper mass including a drive;

a lower mass which comprises a vibration exciter driven by the drive and which is coupled to the upper mass by way of a spring device, wherein the vibration exciter includes at least two variable position unbalanced masses; and a controller including an adjusting piston which is hydraulically actuatable to change a position of the unbalanced masses relative to another portion of the exciter, a reference piston having a first side that is hydraulically coupled to one side of the adjusting piston and having a second side, an electrical signal-generating device that generates an electrical position signal indicative of a position of the reference piston, a control device that is responsive to the electrical position signal and to an operating signal which is provided by an operator to generate a control signal, and a valve which is responsive to the control signal from the control device to selectively hydraulically connect the second side of the reference piston to source of pressurized fluid and to a fluid return line, respectively.

14. The ground compaction device as claimed in claim 13, wherein the position of the adjusting piston can be only changed by changing the position of the reference piston.

15. The ground compaction device as claimed in claim 13, wherein the volume of fluid between the adjusting piston and the reference piston is substantially constant.

16. The ground compaction device as claimed in claim 13, wherein the adjusting piston is disposed on the vibration exciter and that the reference piston is disposed in a region which, in terms of vibration, is uncoupled from the vibration exciter.

17. The ground compaction device as claimed in claim 13, wherein the electrical signal-generating device comprises one of a proximity sensor, an induction coil, a pressure sensor and an optical sensor.

18. The ground compaction device as claimed in claim 13, wherein the electrical position signal is output by the signal-generating device via one of an optical display and an acoustic display.

19. The ground compaction device as claimed in claim 13, wherein the electrical position signal represents an actual value of the position of the unbalanced masses and the operating signal represents a desired value of the position of the unbalanced masses, and further comprising a regulating device which is provided in the control device and which generates the control signal in dependence upon a difference between the actual value and the desired value.

20. The ground compaction device as claimed in claim 13, wherein the first side of the reference piston is connected by way of a non-return valve to the return line, wherein the non-return valve prevents a discharge of fluid from the first side of the reference piston to the return line.

21. The ground compaction device as claimed in claim 13, further comprising one of a flow-obstacle and a restrictor in the oil return line.

22. The ground compaction device as claimed in claim 13, wherein the reference piston includes a piston rod and the electrical signal-generating device generates the electrical position signal in dependence upon a position of the piston rod.

23. The ground compaction device as claimed in claim 13, wherein the piston rod is disposed on the second side of the reference piston.

* * * * *